US010232526B2

(12) United States Patent
Omloo

(10) Patent No.: US 10,232,526 B2
(45) Date of Patent: Mar. 19, 2019

(54) DEVICE AND METHOD FOR CASTING CONCRETE OBJECTS

(71) Applicant: Franciscus Paulus Wilhelmus Maria Omloo, Heers (BE)

(72) Inventor: Franciscus Paulus Wilhelmus Maria Omloo, Heers (BE)

( * ) Notice: Subject to any disclaimer, the term of this patent is extended or adjusted under 35 U.S.C. 154(b) by 787 days.

(21) Appl. No.: 14/418,493

(22) PCT Filed: Jul. 1, 2013

(86) PCT No.: PCT/NL2013/050474
§ 371 (c)(1),
(2) Date: Jan. 30, 2015

(87) PCT Pub. No.: WO2014/021711
PCT Pub. Date: Feb. 6, 2014

(65) Prior Publication Data

US 2015/0258710 A1 Sep. 17, 2015

(30) Foreign Application Priority Data

Jul. 30, 2012 (NL) ..... 2009254

(51) Int. Cl.
*B28B 13/02* (2006.01)
*B28B 7/02* (2006.01)
*B28B 7/34* (2006.01)

(52) U.S. Cl.
CPC ..... *B28B 13/02* (2013.01); *B28B 7/02* (2013.01); *B28B 7/342* (2013.01)

(58) Field of Classification Search
CPC ..... B28B 2013/0265; B28B 17/0081
USPC ..... 264/40.4, 333; 425/145, 147
See application file for complete search history.

(56) References Cited

U.S. PATENT DOCUMENTS 7,018,577 B2 * 3/2006 Bilgram ..... B29C 39/10 264/135
2003/0201559 A1 * 10/2003 Bellasalma ..... B29B 7/72 264/40.5

FOREIGN PATENT DOCUMENTS

DE 19925181 A1 12/2000

* cited by examiner

*Primary Examiner* — Christina A Johnson
*Assistant Examiner* — Xue H Liu
(74) *Attorney, Agent, or Firm* — Hoffmann & Baron, LLP

(57) ABSTRACT

The invention relates to a device and a method wherein a product mold is placed in a basin. The product mold is filled with wet concrete and an intermediate space between the product mold and the basin is filled with a non-hardening slurry having a density substantially similar to the density of the wet concrete. During the filling, the level difference between the wet concrete surface level and the non-hardening slurry surface level is controlled such that the pressure of the wet concrete on the inside of an outer wall of the form mold is substantially balanced by the pressure of the slurry on the outside of the outer wall of the form mold. The invention thus enables the use of a product mold that differs from traditional form works in that its outer wall does not need to support the pressure of the wet concrete contained within the product cavity.

9 Claims, 4 Drawing Sheets

DEVICE AND METHOD FOR CASTING CONCRETE OBJECTS

CROSS-REFERENCE TO RELATED APPLICATIONS

This application is the National Stage of International Application No. PCT/NL2013/050474 filed Jul. 1, 2013, which claims the benefit of Netherlands Application No. NL 2009254, filed Jul. 30, 2012, the contents of which is incorporated by reference herein.

FIELD OF THE INVENTION

The present invention relates to a device for casting concrete objects.

BACKGROUND OF THE INVENTION

It is well-known to cast concrete objects which are round, circular, square, rectangular or any other well-defined linear or symmetrical shape, such as walls, floor slabs, pillars, tiles and a few other constructional elements. These objects are designed with a relatively simple geometry in order to provide for a relatively inexpensive construction material.

Concrete objects are manufactured by casting wet concrete in a formworks, and removing the formworks after the concrete has hardened. The shape of the formworks defines the shape of the final concrete product. Furthermore, the formworks needs to support the weight of the wet concrete poured in the formworks to form the final concrete product. Since the weight of wet concrete is substantial, formworks are typically made of wood or steel.

These traditional formworks are time consuming and expensive to erect. In particular the manufacture of concrete objects with curved surfaces requires the use of elaborate and complicated formworks. It is furthermore noted that the form defining function and the support function of the formworks are closely related. Thus, a form change of the product cavity typically requires a significant change in the design of the overall formworks.

Formworks comprising fabric sections are also known. Fabric material is used for providing curved surfaces because the material is easier to handle, i.e. bend and cut, than wooden or steel plates. The fabric material is typically supported by a steel support frame of concrete reinforcing members. The strength of the fabric, the support frame, and the connections between the fabric and the support frame are critical since they form the product mould, and thus have to support the weight of the wet concrete after the product mould has been filled. Therefore, the application of these kinds of formworks is limited to the construction of simple shapes such as columns and foundation footing.

SUMMARY OF THE INVENTION

It is the object of the present invention to provide an alternative device and method for manufacturing concrete objects, which preferably overcome or substantially reduces at least one of the above mentioned disadvantages.

This object is achieved by providing a device and a method according to the present invention.

A device for casting a concrete product according to the invention comprises:

- a product mould, the product mould defining a product shape defining cavity, said cavity being delimited by an outer wall of the mould and being adapted to be filled with wet concrete that hardens in the cavity to form the concrete product,
- a slurry basin, which slurry basin is adapted to receive therein at least partially the product mould such that an intermediate space is present between at least a portion of the outer wall of the product mould and the slurry basin,
- a wet concrete supply device, which wet concrete supply device is adapted to provide a flow of wet concrete into the product cavity of the product mould to fill the product cavity with wet concrete,
- a control system, the control system comprising control means adapted to control, while the product cavity is being filled with wet concrete, the level difference between the wet concrete surface level inside the product mould and the slurry surface level in the slurry basin, preferably to keep the level difference substantially constant.

A device according to the invention comprises a slurry basin for receiving the product mould to provide the product mould with support. According to the invention, the pressure of the wet concrete on the inside of the outer wall of the product mould is substantially balanced by the pressure of the non-hardening slurry on the outside of the outer wall of the product mould. Supporting the outside of the product mould with non hardening slurry allows for using a product mould that does not need to support the full weight of the wet concrete and even allows for a product mould made of flexible materials. Thus, the product mould can be of a less complicated design and can be made in less time and with less effort.

A method according to the invention can make use of a device according to the invention. Alternatively, a method according to the invention also allows for positioning or lowering the product mould into the slurry basin by hand, as well as filling the product mould with wet concrete and the slurry basin with slurry by hand while checking the wet concrete surface level and the slurry surface level by sight. In such a case, the basin and the mould are preferably at least partially transparent or provided with windows to facilitate monitoring the surface levels, and thus the surface level difference by sight. Thus, the level difference between the wet concrete surface level and the slurry surface level can be controlled, more in particular can be kept substantially constant. The methods also allow for using a device for some of the actions while performing other actions by hand or visually.

To enable the invention to its fullest potential, it is important that during the filling of the mould the slurry level outside the mould is substantially level with the wet concrete surface level inside the mould, or that the level difference is kept within an acceptable band width. It is possible to provide a level difference to provide a slight overpressure, either outside or inside the mould, to optimally position the mould against for example a positioning frame or to optimally stretch the material the mould is made of. The overpressure is provided by keeping the surface levels non-level, i.e. keep the non-hardening slurry surface level below or above the wet concrete surface level.

Keeping the wet concrete surface level and the non hardening slurry level substantially level during the filling of the product mould can be achieved in different ways according to the invention.

The product mould can be placed in the slurry basin after which the product mould is filled with wet concrete and the slurry basin is filled with non hardening slurry. The flow of wet concrete into the product mould and/or the flow of wet slurry are controlled to keep the wet concrete surface level inside the mould and the non hardening slurry level outside the mould substantially level such that the pressure on the inside of the product mould is similar to the pressure on the outside of the product mould, or to provide a pre determined and limited level difference to provide an overpressure on the inside or outside of the product mould.

Alternatively, the product mould can be lowered into an at least partially filled slurry basin. While the product mould is lowered into the slurry. The flow of wet concrete into the product mould and/or the speed at which the product mould is lowered into the non hardening slurry are controlled to keep the wet concrete surface level inside the mould and the non hardening slurry level outside the mould substantially level such that the pressure on the inside of the product mould is similar to the pressure on the outside of the product mould, or to provide a pre determined and limited level difference to provide an overpressure on the inside or outside of the product mould.

In both cases, i.e. placing the product mould in the slurry basin prior to filling it with wet concrete and lowering the product mould into the non hardening slurry while filling it with wet concrete, a control system controls, while the product cavity is being filled with wet concrete, the level difference between the wet concrete surface level inside the product mould and the slurry surface level in the slurry basin, preferably to keep the level difference substantially constant. Thus, in both cases, the pressure of the wet concrete on the inside of the outer wall of the form mould is substantially balanced by the pressure of the non-hardening slurry on the outside of the outer wall of the form mould.

The non hardening slurry, due to its capability to flow, can adapt to complicated and curved forms of the product mould and can thus keep pace with the wet concrete flowing inside the mould during the filling process. Thus, due to similarities in the behavior of slurry and wet concrete, the pressure of the wet concrete on the inside of the outer wall of the form mould can be substantially balanced by the pressure of the non-hardening slurry on the outside of the outer wall of the form mould during the filling. By providing a slurry basin for receiving a non hardening slurry, the invention thus allows for a continuous filling process.

Furthermore, because according to the invention the outer wall of the product mould does not have to support the pressure of the volume of wet concrete, the mould wall can be made of thin and/or flexible materials, for example sheet metal, plastic sheets, fabric, etc. The advantage of using these kinds of materials is that they are much easier to manipulate, i.e. lift and/or bend and/or cut, than for example steel plates and wooden planks. Furthermore, these kinds of materials facilitate providing curved and double curved surfaces. Also, a product mould according to the invention does not need an extensive support frame. Providing a product mould thus takes less time and less material, such that the costs for providing a product mould are reduced.

The above can also be achieved with a method according to the invention. Such a method can make use of a device according to the invention in which case a control system controls the level difference between the wet concrete surface level inside the product mould and the slurry surface level in the slurry basin by controlling the flow of wet concrete and/or slurry and/or lowering the lowering of the mould into the slurry. Preferably the control system in addition comprises one or more sensors for providing information about a representative of the non-hardening slurry surface level in the intermediate space and/or the wet concrete surface level in the product cavity, such as pressure sensor, position sensor, optical sensor, camera, etc. Thus, the control system can actively monitor the respective surface levels and the level difference between them.

A method according to the invention can make use of a device according to the invention. A method according to the invention also allows for positioning or lowering the product mould into the slurry basin by hand, as well as filling the product mould with wet concrete and the slurry basin with slurry by hand while checking the wet concrete surface level and the slurry surface level by sight. Thus, a method according to the invention allows for control of the level difference between the wet concrete surface level and the slurry surface level, more in particular allows for keeping the level difference substantially constant, while filling the mould.

A device or method according to the invention thus allows for using product moulds made of low cost and/or low strength materials. Also, the product moulds are lighter than known formworks, and are thus easier to handle. Typically, the mould is provided prior to the filling process.

In an embodiment, a device for casting a concrete product according to the invention comprises a product mould, a slurry basin, a wet concrete supply device, a non-hardening slurry supply device and a control system.

The product mould defines a product shape defining cavity, said cavity being delimited by an outer wall of the mould and being adapted to be filled with wet concrete that hardens in the cavity to form the concrete product.

The slurry basin is adapted to receive therein at least partially the product mould such that an intermediate space is present between at least a portion of the outer wall of the product mould and the slurry basin.

The wet concrete supply device is adapted to provide a flow of wet concrete into the product cavity of the product mould to fill the product cavity with wet concrete.

The non-hardening slurry supply device comprises a slurry storage for storing a non-hardening slurry having a density substantially similar to the density of concrete. The non-hardening slurry supply device is adapted to provide a flow of the non-hardening slurry into the slurry basin, more in particular into the intermediate space present between at least a portion of the outer wall of the product mould and the slurry basin, to fill the intermediate space with non-hardening slurry.

The control system comprises control means adapted to control filling of the product cavity and/or filling of the slurry basin such that, while filling the product cavity with wet concrete and the intermediate space with non-hardening slurry, the level difference between the wet concrete surface level and the slurry surface level can be controlled, preferably can be kept substantially constant.

With a device according to the invention, the pressure of the wet concrete on the inside of the outer wall of the form mould is substantially balanced by the pressure of the non-hardening slurry on the outside of the outer wall of the form mould. More in particular, during the filling of the product mould, the intermediate space on the outside of the form mould is filled at substantial equal pace with a non-hardening slurry. Thus, the hydrostatic pressure exerted by the wet concrete and the non-hardening slurry on opposite sides of the outer wall of the product mould is substantially similar. The device according to the invention thus enables the use of a product mould that differs from traditional formworks in that it, more in particular its outer wall, does not need to fulfill a support function, i.e. does not need to withstand the pressure of the wet concrete contained in the product cavity.

The control system is adapted to control the filling of the product mould and/or the slurry basin such that the non-hardening slurry level can be kept at a substantially constant level difference with the wet concrete surface level in the product mould while filling the product cavity with wet concrete and the intermediate space with non-hardening slurry. By filling the intermediate space with non-hardening slurry that has a density substantially similar to the density of wet concrete, the pressure of the slurry on the outer wall of the product mould substantially balances the pressure of the wet concrete on the other side of the outer wall. By enabling to thus support the outside wall of the product mould, the device according to the invention enables to limit the pressure difference between the inside and the outside of the outer wall.

Because the outer wall of the product mould does not have to support the pressure of the volume of wet concrete, the mould wall can be made of thin and/or flexible materials, for example sheet metal, plastic sheets, fabric, rubber, silicone, latex, etc. The advantage of using these kinds of materials is that they are much easier to manipulate, i.e. lift and/or bend and/or cut, than for example steel plates and wooden planks. Furthermore, these kinds of materials facilitate providing curved and double curved surfaces. Also, a product mould according to the invention does not need an extensive support frame. Providing a product mould thus takes less time and less material, such that the costs for providing a product mould are reduced.

A device according to the invention thus allows for using product moulds made of low cost and/or low strength materials. Also, the product moulds are lighter than known formworks, and are thus easier to handle.

In an embodiment according to the invention, the control system comprises one or more sensors for providing information about a representative, such as pressure, of the non-hardening slurry surface level in the intermediate space and/or the wet concrete surface level in the product cavity. Thus, the control system can adjust the filling of the product cavity and/or filling of the slurry basin based on the actual surface level(s). This is especially beneficial when the product cavity and/or the intermediate space are of irregular shape, such that the rise of the surface levels, and thus the pressure increase in the wet concrete and the non-hardening slurry, during filling of the product cavity and intermediate space is difficult to predict. In a further embodiment, the control system is provided with one or more devices for determining the mass of the wet concrete and/or the non-hardening slurry.

In an embodiment, the density of the non-hardening slurry is in the range of 90% to 110% the density of wet concrete, preferably is in the range of 95% to 105%, more preferably is in the range of 98% to 102% the density of wet concrete. It is noted that the better the density of the non-hardening slurry matches the density of the wet concrete, the more accurate the pressure of the wet concrete on the form mould wall can be balanced using the slurry. The non-hardening slurry supports the outer mould wall and thus allows for the use of form moulds made of a flexible material, such as foil, rubber or fabric, and the use of simple connections between components of the mould, for example connecting the components by sewing them together, or by using tape and/or staples, by using magnetic strips, etc. Furthermore, the product mould does not need to be air or water tight.

Preferably, the control system is adapted to keep the level difference between the wet concrete surface level and the slurry surface level substantially constant during the filling of the product cavity and the intermediate space. It is noted that for example irregularities in the flow of wet concrete and/or the flow of non-hardening slurry, an irregular shaped product cavity and/or irregular intermediate space, etc. may cause irregularities in the rise of the surface levels, and thus influence the level difference between the respective surface levels. Because the control system controls the filling of the product cavity and/or the intermediate space, it can adjust for these kinds of irregularities, and thus keep the level difference substantially constant.

In an embodiment, the control system is adapted to maintain the wet concrete surface level substantially level with the non-hardening slurry surface level during the filling of the product cavity with wet concrete and the intermediate space with non-hardening slurry. The level difference is thus substantially zero. The pressure of the wet concrete against the outer wall of the form mould is thus substantially the same as the pressure of the non-hardening slurry against the outer wall of the form mould. Because the pressure difference between the inside and the outside of the outer wall is kept to a minimum, the mould wall can be made out of thin and/or flexible materials that can be combined using simple connections.

Preferably the control system is adapted to, during the filling of the product cavity and the intermediate space, maintain the level difference between the wet concrete surface level and the non-hardening slurry level below 3 cm, preferably below 2 cm, more preferably below 1 cm, most preferably about 0 cm.

In an embodiment the control system is adapted to maintain a positive level difference between the wet concrete surface level and the non-hardening slurry level, i.e. keep the wet concrete surface level and the non-hardening surface level non-level, during the filling of the product cavity with wet concrete and the intermediate space with non-hardening slurry, such that the pressure of the wet concrete against the outer wall of the form mould differs from the pressure of the non-hardening slurry against the outer wall of the form mould.

For example, the wet concrete surface level can be constantly kept slightly above the non-hardening slurry level during the filling of the product cavity and the intermediate space. Thus, the pressure of the wet concrete against the outer wall of the form mould is slightly higher than the pressure of the non-hardening slurry against the outer wall of the form mould. Thus, the form mould can be biased, for example pressed outwards against for example a support ring encircling the form mould to keep the form mould together, or against spacers or a framework provided in the intermediate space to define the position of the outer wall.

Alternatively, the wet concrete surface level can be kept slightly below the non-hardening slurry level during the filling of the product cavity with wet concrete and the intermediate space with non-hardening slurry. Thus, the pressure of the wet concrete against the outer wall of the form mould is slightly lower than the pressure of the non-hardening slurry against the outer wall of the form mould, and the outer wall is pressed inwards, for example to correctly position the wall against a framework provided in the product cavity.

Preferably the control system is adapted to, during the filling of the product cavity and the intermediate space, maintain a level difference between the wet concrete surface level and the non-hardening slurry level of at least 1 cm, preferably within a range of 1 cm to 9 cm, more preferably within a range of 1 to 6 cm, most preferably within a range of 1 to 5 cm, for example about 2 cm.

It is noted that the acceptable and/or required level difference amongst others depends on the design of the mould, i.e. the type of material used, the rigidity of the material used, the strength of the connection between different sections of the mould provided, etc. In some cases, the easiest way for the skilled person to determine an optimal combination between a mould design and surface level difference will be by simple trial and error. It is believed that this text provides sufficient information to enable the skilled person to do so.

In an embodiment, the control system is adapted to, during the filling of the product cavity and the intermediate space, maintain the wet concrete surface level substantially level with the non-hardening slurry surface level for one or more periods, and maintain a level difference between the wet concrete surface level and the non-hardening slurry level for one or more other periods during the filling process. Thus it is for example possible to keep both surface levels substantially equal during the first half of the filling process and keep the non-hardening slurry surface level slightly above the wet concrete surface level during the second half of the filling process, and thus to apply a slight overpressure in the non-hardening slurry only after half the product cavity has been filed with wet concrete. Thus, the surface levels are alternatingly kept level and kept non-level during respective periods of the filling process, Preferably, the control system is adapted to maintain the level of non-hardening slurry at a constant distance above, below, as well as substantially level with the surface level of the wet concrete during filling of the product mould and the intermediate space. Thus, the filling process can be adapted to fit the design of different product moulds.

In an embodiment, the control system is adapted to control the flow rate of wet concrete into the product cavity and/or to control the flow rate of slurry into the intermediate space, for example by operating valves in inlet channels. Thus the control system can control the rise of the surface level of the wet concrete and/or the surface level of the non-hardening slurry, and thus control the level difference.

In an embodiment, the control system is provided with one or more sensors that measure the flow rate of the wet concrete into the product cavity and/or the flow rate of the slurry into the intermediate space. This is especially useful when the control system is adapted to control the respective flow rates. The information can be used to for example predict the potential speed with which the surface level will rise. The information can for example be combined with information about the volume and/or shape of the intermediate space and/or product cavity, or with information about the speed with which the surface level(s) rise(s), to more effectively control the level difference during the filling process.

In a further embodiment the control system is provided with a volume adaptation device, such as a movable basin wall member or an expandable body, which volume adaptation device is provided in the slurry basin such that the volume of the intermediate space can be adapted prior to the filling of the product mould with wet concrete and/or the filling of the intermediate space with non-hardening slurry. Thus, the volume of the intermediate space can be adapted, for example to more closely match the volume of the product cavity such that equal flows of wet concrete and non-hardening slurry result in substantially similar rising speeds of the respective surface levels.

In an embodiment, a non-hardening slurry inlet is provided near a bottom surface of the slurry basin. By filling the basin, more in particular the intermediate space, from below, the turbulence in the slurry is kept to a minimum. This further facilitates maintaining a constant distance between the slurry level and the concrete level. The same affect can be achieved by feeding the non-hardening slurry into the basin using a tube hanging down in the intermediate space such that the outlet opening of the tube is located close to the bottom surface of the intermediate space.

In a preferred embodiment, the non-hardening slurry is fed into the intermediate space from above. Preferably, a non-hardening slurry inlet is provided that is moveable in the vertical direction, for example by providing a tube hanging down in the intermediate space, which tube is lifted such that the outlet opening of the tube is kept close to the rising surface level of the non-hardening slurry. Thus, compared to freely pouring the non-hardening slurry from the top of the basin into the intermediate space, the turbulence in the non-hardening slurry in the intermediate space is kept to a minimum. Such turbulence may cause unwanted pressure differences adjacent the product mould outer wall.

In an embodiment, a wet concrete inlet is provided in a central region of a bottom surface of the slurry basin. The inlet may be connected to the product cavity via a tube, or directly. In the latter case, the product mould is provided with an open bottom, or an opening in a bottom surface of the product mould, which is placed over the slurry inlet. Thus, the slurry can be fed into the product cavity via the bottom of the slurry basin.

In a preferred embodiment, the wet concrete is fed into the product cavity from above. Preferably, a wet concrete inlet is provided that is moveable in the vertical direction, for example by providing a tube hanging in the product cavity, which tube is lifted during the filling process such that the outlet opening of the tube is kept close to the rising surface level of the wet concrete. Thus, compared to freely pouring the wet concrete from the top of the product mould into the product cavity, the turbulence in the wet concrete in the product cavity is kept to a minimum. Such turbulence may cause unwanted pressure differences adjacent the product mould outer wall.

In an embodiment of a device according to the invention, the slurry basin has a bottom surface, which bottom surface forms the bottom surface of the product shape defining cavity and the intermediate space. This is the case when the product mould is provided with walls only and has no bottom separating the cavity from the bottom surface of the basin. Thus, the bottom surface of the slurry basin forms the bottom surface of the product cavity. In such an embodiment a sensor or slurry inlet provided in or on the basin bottom can be used in the product cavity. In an alternative embodiment, the product mould is provided with a bottom having an opening therein for receiving for example an inlet or sensor provided in or on the bottom surface of the basin.

In an embodiment, the form mould has a bottom surface, and the intermediate space has a bottom surface, which bottom surfaces are located at substantially the same level. This further facilitates keeping the pressure at both sides of the form mould outer wall in balance by keeping the wet concrete surface level and the non-hardening slurry surface level substantially level while filing the respective product cavity and intermediate space.

In an embodiment, the filling of the product cavity and the intermediate space is a continuous process. Alternatively, the filling process can be a sequence of filling steps, between which steps the flow of wet concrete and/or non-hardening slurry is reduced or even stopped.

In an embodiment, a single inlet is provided in the product cavity and a single inlet is provided in the intermediate space. In a further embodiment, the product cavity and/or the intermediate space are provided with multiple inlets.

In an embodiment, an inlet is moveable in the vertical direction, such that it for example can be kept within a set distance relative to the surface level. In a further embodiment, an inlet is movable in the horizontal direction to thus facilitate the distribution of the wet concrete in the product cavity and/or the non-hardening slurry in the intermediate space.

To enable the filling of the product mould and/or the slurry basin such that the level difference is kept substantially constant, for example the non-hardening slurry level in the intermediate space is kept at a substantially constant level difference of 0.5 cm above the wet concrete surface level in the product mould, the control system, for example a computer, is preferably provided with one or more sensors for providing information about a representative of the non-hardening surface level in the intermediate space and the wet concrete surface level in the product cavity.

The sensors can for example provide the control system with information about the flow rate of the wet concrete and/or the non-hardening slurry into the respective form cavity and intermediate space, with information about the pressure in the wet concrete and/or in the non/hardening slurry in the respective form cavity and intermediate space, with information about the wet concrete surface level and/or the non-hardening slurry surface level in the respective form cavity and intermediate space, etc.

For example the control system can be provided with sensors adapted to measure the height of the wet concrete surface level relative to a reference level, for example the bottom surface of the basin, and with sensors adapted to measure the height of the non-hardening slurry level to that reference level. Thus, the level difference can be calculated.

In an embodiment, the control system is provided with sensors adapted to measure the pressure in the wet concrete in the product cavity and/or of the pressure in the slurry in the intermediate cavity, preferably measuring both and measuring both at the same level. For example, pressure sensors can be provided at the end of wires hanging in, or at the end of rods extending into the product cavity and/or the intermediate space. It is noted that the pressure information is only needed while filling the product cavity and the intermediate space. The sensors can thus be removed when the filling process has ended. Thus, the sensor can be removed from the product cavity prior to the hardening of the concrete In an embodiment, pressure sensors are provided in, on or near a bottom surface of the slurry basin, more in particular in, on or near a bottom surface of the intermediate space and/or in or near a bottom surface of the product cavity. For providing information on the pressure in the product cavity, the product mould can be provided with an opening to be located above the sensor, or with a thin flexible bottom wall. Also, sensors can be provided in or on the wall of the product mould.

In a further embodiment, the control system is provided with input means, for example a keyboard or wireless broadband connection, via which for example a user can enter information about the particular volume of a product cavity, an intermediate space and/or flow rate of slurry or wet concrete, properties of the non-hardening slurry and the wet concrete, such as for example mass, etc., which information can be used by the control system to more precisely control the surface level difference during the filling process.

In an embodiment, the majority of, preferably the entire, outside wall of the product mould is made out of a low strength material such as thin plywood, woven or unwoven fabric material, plastic sheet, rubber, rubber sheet, silicone, silicone sheet, latex or foil material, blow moulded or vacuum moulded plastic sheet material, or foam material such as Styrofoam. Such a product mould would normally collapse when used for forming concrete products. The invention provides a non hardening slurry support for these types of moulds, which support is evenly distributed over the outer wall, more in particular matches the load distribution of the wet concrete in the product mould. Since with a device according to the invention the pressure exerted on the outer wall of the mould by the wet concrete is substantially balanced by the pressure exerted on the outer wall of the mould by the non-hardening slurry, the above mentioned types of materials can be used for a product mould, more in particular for providing the product mould with a thin outer wall, preferably of substantially constant thickness, that is not able to contain the wet concrete within the product cavity when not supported. This is beneficial since, compared to plywood and steel plates used for traditional formworks, these kinds of materials are easy to handle and form into a mould.

For example, in an embodiment, the product mould is made from fabric sections that are cut from a sheet and sewn together to form a three dimensional product cavity. The use of fabric provides the product mould with a skin like outer wall. Fabric lacks any substantial bending stiffness and can be stretched over and along a positioning structure to provide a three dimensionally shaped product mould. It is noted that by simply sewing sections of fabric together a three dimensional form mould can be created that is self-supporting and does not need any framework for correctly positioning the outer wall of the product mould.

In an embodiment, plastic sheets are used to form a product mould. Plastic sheets can for example be cut, bend and glued together and/or shaped using a vacuum moulding or blow moulding technique.

In another embodiment the form mould is made from thin sheet metal, for example aluminum, which sheet metal can be bent by hand or manipulated using simple appliances. Thus the mould can be formed by hand, which for example allows for last minute adaptations to the form mould, or for example adapting the form of the product mould after casting a first concrete product and prior to casting a subsequent concrete product using the same product mould or parts thereof. In an embodiment, the metal sections are cut from a metal sheet, through non-elastic deformation are manually aligned to a predefined contour and fixed to each other and optionally to a positioning frame or the walls of the slurry basing. The metal sections can for example be connected using magnetic strips, adhesive tape, welding, etc.

Since the product mould of a device according to the invention does not need to support large pressures, components of the mould can be connected to each other using simple connections, for example using adhesive tape or clamps. In an embodiment, the wall sections of the product mould are connected to each other or to a wall of the slurry basin using magnetic connections. For example sheet metal sections of the form mould can be connected to each other using a magnetic flexible strip. These kinds of connections are easy to apply and easy to remove, and thus allow for making adjustments to the mould and for easy assembly and disassembly of the form mould. The latter facilitates demoulding the final product.

In an embodiment, the mould is partially made of comparatively strong sections, i.e. sections strong enough to support the load of the wet concrete without support by the non-hardening slurry, and comparatively weak sections, i.e. sections that would collapse or tear when subjected to the load of the wet concrete without support by the non-hardening slurry. Such a mould for example comprises comparatively strong sections, for example made out of steel plate having a thickness of 4 mm, in combination with comparatively weak sections, which are for example made out of formed sheet metal having a thickness of 0.5 mm. Especially when the weaker sections have a large surface area they are susceptible to bending when subjected to a load of wet concrete unbalanced by non-hardening slurry.

For example, for providing a concrete plate with one curved surface, a mould can be provided with a, when seen in top view, U-shaped strong mould section, for example made of steel or wood. The U-shaped strong mould section is combined with a comparatively weak, curved plate section, which section is for example made of thin blow moulded plastic sheets. The curved plate section is attached to the ends of the legs of the U-shaped section, for example using tape, such that, when seen in top view, the curved plate bridges the space between the legs. Thus a product mould in the form of a profile section with an open top and bottom is created. The product mould is subsequently placed in the slurry basin, with one of the opposite openings on the bottom surface of the slurry basin and such that there is an intermediate space between at least the weaker curved mould section surface of the product mould and the slurry basin, more in particular the slurry basin wall. The product mould and intermediate space are subsequently filled to form the concrete plate with a curved surface, the latter being shaped by the curved plastic sheet section.

It is noted that a device according to the invention is especially advantageous for providing support for curved mould surfaces. Providing a mould with a curved surface according to the prior art requires the use of thick and strong materials, such as steel plates having a thickness of 5 mm and over, which are not easy to shape and handle and/or require elaborate support of the mould in the form of extensive scaffolding, framework, etc.

The product cavity and the intermediate space of a device according to the invention are preferably provided with an air drain, which allows for air to escape from the product cavity and the intermediate space during the filling process. The air drain is for example provided in the shape of an open top.

It is noted that when the outer mould is made out of a sheet material the wall thickness of the product mould is substantially constant. In a further embodiment, the product mould is composed out of one or more shell shaped components, i.e. components having curved surfaces and a substantially constant wall thickness. Such components can for example be made by vacuum moulding sheets of plastic material.

With a device according to the invention, the product mould can be made out of comparatively thin sheet material, such as metal and plastic sheets, for example made of PET material. In particular plastic sheets tend not to adhere to wet concrete, and thus allow for easy demolding and reusing the mould. The invention furthermore facilitates providing concrete products with a relief pattern, since sheet material allows for easy deformation. For example a simple stamping technique can be used to provide metal sheets with a relief pattern, and plastic sheets can be provided with a relief pattern using vacuum moulding techniques. This is not possible with traditional formworks, which are made out of thick steel or wooden plates.

In an embodiment, the device comprises in the product mould and/or in the intermediate space a product mould support, preferably a product mould support frame, adapted to support, more in particular position the product mould or parts thereof. Thus, the mould or parts therefor can be supported by the frame. This is especially beneficial when using thin and flexible material, for example fabric material, to form the outer wall of the product mould that is not self supporting. Thus, the product mould support according to the invention is configured to support the mould, more in particular to position parts of the mould. It is noted that the product mould support frame does not enable the product mould to support the weight of wet concrete without the support of the non-hardening slurry, but is configured to correctly position the product mould, more in particular the wall of the product mould, during the filling process. A product mould support frame according to the invention is thus also referred to as a positioning frame.

It is noted that support frames are used with known formworks to support the product mould. These known support frames are however designed to support large loads, i.e. the weight of the heavy form mould as well as the wet concrete contained therein. With a device according to the invention, simple light weight frameworks can be used. In an embodiment, for example frameworks composed of thin aluminum or steel wires, which can be bend by hand in the correct position, may be used since a frame for supporting the outer wall of a product mould according to the invention does not need to support heavy loads.

It is noted that in an embodiment, the device comprises a product support, preferably a product support frame, located in the intermediate space for supporting the product mould and the final concrete product. Thus, after the concrete has hardened, the slurry can be removed from the slurry basin without the risk of the concrete product tipping over. Such a product support frame may need to be able to support substantive loads in order to support the final concrete product or parts thereof prior to removing the product form the basin and after the slurry has been removed form the basin.

In an alternative embodiment the product mould is suspended in the slurry basin, for example using a crane or truss located above the basin. The crane or truss can also be used for lifting the concrete product from the basin. In a further embodiment, the concrete product is provided with an internal wire frame having protruding parts, for example hooks or loops, to connect wires to the product for support or lifting the product from the mould after the concrete has hardened.

In an embodiment, the device is adapted to remove the slurry from the intermediate space, preferably in the form of a slurry outlet. Preferably, the device is provided with a slurry reservoir to hold the slurry such that the slurry can be reused when providing a subsequent concrete product.

In an embodiment, the device is provided with one or more pumps to move the non-hardening slurry and or wet concrete through conduits, tubes, and/or inlets and outlets into or out of the slurry basin and or product cavity.

In an alternative embodiment of a device for casting a concrete product according to the invention, the device comprises a product mould, a slurry basin, a wet concrete supply device, a control system and a lowering device, for example a crane.

The product mould defines a product shape defining cavity, said cavity being delimited by an outer wall of the mould and being adapted to be filled with wet concrete that hardens in the cavity to form the concrete product.

The slurry basin is adapted to receive therein at least partially the product mould such that an intermediate space is present between at least a portion of the outer wall of the product mould and the slurry basin.

The control system comprises control means adapted to control, while the product cavity is being filled with wet concrete, the level difference between the wet concrete surface level inside the product mould and the slurry surface level in the slurry basin, preferably to keep the level difference substantially constant.

The lowering device is configured for, when the slurry basin is at least partially filled with slurry, lowering the product mould into the slurry basin, more in particular for lowering the product mould into non hardening slurry held by the slurry basin, such that an intermediate space filled with non hardening slurry is present between at least a portion of the outer wall of the product mould and the slurry basin.

The wet concrete supply device is adapted to provide a flow of wet concrete into the product cavity of the product mould to fill the product cavity with wet concrete. The wet concrete supply device is furthermore adapted to provide the flow of wet concrete into the product cavity of the product mould while the product mould is lowered into the slurry held in the slurry basin.

The control system comprises control means adapted to control the lowering device and/or the wet concrete supply device, and is adapted to control the lowering of the product mould and/or the supply of the wet concrete such that the level difference between the wet concrete surface level and the slurry surface level can be controlled, preferably can be kept substantially constant, The device preferably comprises a non-hardening slurry supply device, which non-hardening slurry supply device comprises a slurry storage for storing a non-hardening slurry having a density substantially similar to the density of concrete, and which non-hardening slurry supply device is adapted to provide a flow of the non-hardening slurry into the slurry basin, preferably into the intermediate space present between at least a portion of the outer wall of the product mould and the slurry basin while the product mould is lowered into the basin, to fill the intermediate space with non-hardening slurry. Preferably, the control system comprises control means adapted to control the non hardening slurry supply device, to control the flow of non hardening slurry into the slurry basin while lowering the product mould into the non hardening slurry held in the non hardening slurry basin, to fill the intermediate space with non-hardening slurry such that the level difference between the wet concrete surface level and the slurry surface level is controlled, preferably is kept substantially constant.

In this alternative embodiment the product mould is lowered into the slurry basin while the product cavity of the product mould is filled with wet concrete. Due to the added volume of the product mould and the wet concrete received therein, the non hardening slurry surface level in the slurry basin will rise, and thus fill the intermediate space between the product mould and the slurry basin. The lowering of the product mould and the flow of wet concrete in the product mould are controlled such that the wet concrete surface level inside the product mould is level with the non hardening slurry surface level in the intermediate space, and rises at a similar pace. In an embodiment, the control system is configured for keeping a level difference between the wet concrete surface level inside the product mould and the non hardening slurry surface level in the slurry basin, to provide an overpressure pushing the walls of the product mould inward or outward, depending on at which side the overpressure is created.

In an embodiment, the product mould is lowered into a partially filled slurry basin and the volume of slurry present in the slurry basin is chosen such that it will fill the entire intermediate space when the product mould has been lowered onto the bottom of the slurry basin.

In an embodiment, the slurry basin is provided with enough non hardening slurry to overflow the non hardening slurry basin when the product mould and wet concrete are lowered into the slurry basin. In such an embodiment, a secondary basin can be provided for receiving the overflowing non hardening slurry. In an alternative embodiment, a device, for example a pump is provided for removing non hardening slurry from the non hardening slurry basin to further control the non hardening slurry surface level relative to the wet concrete surface level.

In an embodiment, non hardening slurry is fed into the non hardening slurry basin while the product mould is lowered into the non hardening slurry. The control device may control the flow of non hardening slurry to further control the level difference between the wet concrete surface level and the non hardening slurry surface level.

According to the invention, during the lowering of the product mould into the non hardening slurry basin, the control system controls the wet concrete supply device and/or the lowering of the product mould and/or the supply of the wet concrete such that the level difference between the wet concrete surface level and the slurry surface level can be controlled, preferably can be kept substantially constant. Thus, the product mould can be lowered into the slurry basin while the wet concrete surface level in the product mould is for example kept substantially level with the slurry surface level in the slurry basin.

In an embodiment, the lowering device is a crane adapted for lowering the mould into the slurry basin. Preferably, the crane is adapted to lift the finished and cured product from the slurry basin as well. In an embodiment, the lowering device and the product mould are configured such that the product mould can be set on the bottom of the non hardening slurry basin. In a further embodiment, the lowering device and the product mould are configured such that the lowering device can be disconnected from the product mould after the product mould is positioned on the bottom of the non hardening slurry basin. In a further embodiment, the lifting device can be reconnected to the product mould to lift it from the non hardening slurry basin, preferably after the wet concrete has set inside the product mould.

In an embodiment the device comprises a product mould transport frame, which product mould transport frame supports the product mould, wherein the slurry basin is configured for receiving the product mould transport frame supporting the product mould, and which product mould transport frame is adapted for cooperating with the lowering device according to the invention, such that the product mould can be lowered into slurry held in the slurry basin by lowering the product mould transport frame into the slurry basin using the lowering means.

In a further embodiment of a device according to the invention, the control system comprises one or more sensors provided on the product mould transport frame for measuring the extent to which the product mould is lowered into the slurry basin, preferably is provided with one or more sensors for measuring the extent to which the product mould supported by the product mould transport frame is lowered into the slurry basin.

In another embodiment according to the invention, the control system comprises one or more sensors provided on the product mould transport frame for measuring the extent to which the product mould is lowered into the slurry, preferably is provided with one or more sensors for measuring the extent to which the product mould supported by the product mould transport frame is lowered into the slurry.

In another embodiment according to the invention, the control system comprises one or more pressure sensors provided in the product cavity of the product mould and one or more pressure sensors on the outside of the product mould. Each pressure sensor on the inside of the product mould is linked to a pressure sensor on the outside of the product mould. The two pressure sensors are provided such that when the product mould is lowered into the slurry basin, the linked sensors are located at the same height in the slurry basin. Thus, when the non hardening slurry has a consistency similar to that of wet concrete, and the wet concrete surface level and the non hardening slurry surface level are leveled, the pressure registered by the two sensors should be similar. The sensors can thus be used to monitor any difference between the two surface levels during the filling process.

In an embodiment according to the invention, the slurry basin is provided with a guide system, for example one or more guide rails, for guiding the product mould transport frame into the slurry basin while the product mould transport frame is lowered into the slurry basin using the lowering means.

In an embodiment according to the invention the product mould transport frame supports the wet concrete supply means.

In an embodiment, the weight of the product mould is such that the product mould sinks towards the bottom of the non hardening slurry basin when placed on top of the slurry inside the non hardening slurry basin. In another embodiment, the product mould is provided with a weight, or is connected to a weight, to help the lowering of the product mould into the slurry. The extra weight prevents the mould from staying (partially) afloat on the slurry and thus enables a controlled lowering of a light weight product mould into the slurry.

In an embodiment, the mould can be located in a product mould transport frame, for example a metal cage, which product mould transport frame is heavy enough to sink into the slurry towards the bottom of the non hardening slurry basin and pull the product mould with it. In an embodiment, the cage is for example cube shaped, and adapted to fit inside of a cube shaped slurry basin. In a further embodiment, the cage can be dimensioned for transport by a standard shipping container, to facilitate transport of the mould. In an alternative embodiment, the cage itself is dimensioned like a standard shipping container and preferably is provided with fastening devices similar to a shipping container to enable direct placement on a lorry or truck.

Alternatively, the product mould can be provided with a heavy bottom plate, for example a steel or concrete bottom plate, the weight of which is sufficient to sink the mould into the slurry basin. In a further embodiment, the bottom plate is provided with fastening devices for attachment to the lowering device. For example, the lowering device can be provided with steel rods that extend in an upward direction and are provided at their upside with loops for coupling with the hook of a crane like lifting device. In a preferred embodiment, the fasting devices are extend above the slurry when the when the product mould is fully lowered into the slurry basin and is. Thus the fastening device are easy accessible for decoupling and coupling with the lifting device.

In an embodiment, the wet concrete supply means are combined or attached to the lifting device, such that the lifting device can be sued for positioning the supply means into the product cavity of the product mould.

In a further embodiment, the lowering device is a lift like lowering device provided in or next to the slurry basin. In a further embodiment, the slurry basin can be provided with a bottom of which the central part can be raised and lowered in order to lower a product mould into the slurry and/or to lift a product mould placed on that part of the slurry basin bottom from the slurry basin.

The invention furthermore provides a method for providing a concrete product, preferably using a device according to the invention, the method comprising the steps:

- providing a product mould, the product mould defining a product cavity for receiving wet concrete to form the concrete product,
- providing a slurry basin, which slurry basin is adapted to receive the product mould,
- positioning the product mould in the slurry basin such that an intermediate space between the slurry basin and at least part of the product mould is created,
- filling the product cavity with wet concrete and filling the intermediate space with non-hardening slurry having a density substantially similar to the density of concrete,
- while filling the product cavity with wet concrete and the intermediate space with non-hardening slurry, controlling the level difference between the wet concrete surface level and the slurry surface level, preferably keep the level difference substantially constant,
- letting the wet concrete harden while the intermediate space remains filled with slurry,
- removing the concrete product from the slurry basin.

A method according to the invention enables providing a concrete product using a simple product mould. Furthermore, the product mould can be made of thin and/or light weight and/or flexible materials, which are easy to manipulate. The method thus facilitates providing the concrete product, in particular facilitates providing a product mould for products having curved surfaces.

In a method according to the invention, the wet concrete surface level and the slurry level in the respective product cavity and the intermediate space are measured while filling the product cavity and the intermediate space. For example floats can be provided that indicate the surface levels, or one or more windows can be provided in the slurry basin and/or the product mould that allow for visual inspection of the surface levels. In an embodiment, the windows can be provided with a scale for indicating the volume or surface level in the cavity and/or basin. Also, sensors and/or lasers can be used to keep track of the surface levels during the filling process.

The surface level information can be used in controlling the level difference between the wet concrete surface level and the non-hardening slurry surface level, preferably keep the level difference substantially constant during the filling of the intermediate space and the product cavity.

In a method according to the invention, the pressure in the wet concrete and the non-hardening slurry in the respective product cavity and the intermediate space are measured while filling the product cavity and the intermediate space. For example pressure sensors can be supported in the product cavity and/or the slurry basin. The pressure sensors can also be provided in the bottom surface and/or the wall surface of the slurry basin and the product mould. The pressure information can be used in controlling the level difference between the wet concrete surface level and the slurry surface level, preferably keep the level difference substantially constant.

In a method according to the invention, the flow rate of a flow of wet concrete into the product cavity and/or the flow rate of a flow of non-hardening slurry into the intermediate space is controlled. By adjusting the flow of one or both of the wet concrete and the non-hardening slurry, unwanted changes in the level difference, for example due to dimensional differences between product cavity and the intermediate space, can be avoided or compensated.

In a method according to the invention, during the filling of the product cavity with wet concrete and the intermediate space with non-hardening slurry, the wet concrete surface level is maintained substantially level with the non-hardening slurry surface level such that the pressure of the wet concrete against the outer wall of the form mould is substantially the same as the pressure of the non-hardening slurry against the outer wall of the form mould.

By balancing the pressure on both sides of the product mould outer wall, there is no or only a small pressure difference between the inside and the outside of the wall. Thus, a support frame for keeping the wall in place during the filling of the form mould is not necessary, or can be comparatively simple since it does not have to support great loads. Because the pressure difference between the inside and the outside of the outer wall is kept to a minimum, the mould wall can furthermore be made out of thin and/or flexible materials that can be combined using simple connections.

In such a method according to the invention, preferably a level difference between the wet concrete surface level and the non-hardening slurry level is maintained below 3 cm, preferably below 2 cm, more preferably below 1 cm, most preferably about 0 cm.

In a method according to the invention, during the filling of the product cavity with wet concrete and the intermediate space with non-hardening slurry, a substantially constant level difference is maintained between the wet concrete surface level and the non-hardening slurry level such that the pressure of the wet concrete against the outer wall of the form mould differs from the pressure of the non-hardening slurry against the outer wall of the form mould.

For example, the wet concrete surface level can be kept slightly above the non-hardening slurry level during the filling process, such that the pressure of the wet concrete against the outer wall of the form mould is slightly higher than the pressure of the non-hardening slurry against the outer wall of the form mould. Alternatively, the wet concrete surface level is maintained slightly below the non-hardening slurry level during the filling process such that the resultant pressure on the outer wall is directed inward.

In such a method, preferably a level difference between the wet concrete surface level and the non-hardening slurry level is maintained of at least 1 cm, preferably within a range of 1 cm to 9 cm, more preferably within a range of 1 to 6 cm, most preferably within a range of 1 to 5 cm, for example about 2 cm.

By providing a pressure difference, the outer wall of the form cavity is pushed slightly inward or outward, depending on the pressure difference. The pressure difference can thus be used to position the wall against a positioning frame provided inside or outside the form mould. Such a positioning frame is provided for keeping the form mould or sections thereof in place. For example, when the product mould is provided with a curved wall element, for example a wall element made by vacuum moulding a sheet of plastic material, a positioning frame can be provided in the intermediate space to limit the freedom of movement of the wall element in the outward direction. The positioning frame can for example be provided with multiple pins that contact the outside surface of the wall element at strategic positions, to prevent it from moving outward. By in addition providing a slight overpressure, by providing a wet concrete surface level slightly above the non-hardening slurry surface level, in the product mould, the wall element is pressed against the positioning frame, more in particular the pins thereof, and thus correctly positioned in the slurry basin.

It is noted that in addition to, or instead of, positioning the wall element the positioning frame can also be used to support for example the upper end of a flexible wall element, to prevent it from collapsing under its own weight.

In a method according to the invention, during the filling of the product cavity and the intermediate space, the wet concrete surface level is maintained substantially level with the non-hardening slurry surface level for one or more periods of the filling process, and a level difference between the wet concrete surface level and the non-hardening slurry level, for example of 1 cm, is maintained for one or more other periods. Thus, for example the surface level of the non-hardening slurry can be kept 1 centimeter above the wet concrete surface level while filling the lower half of the mould, and the surface levels can be kept substantially level while filling the upper half of the mould.

In a further method the level difference is kept substantially zero during the filling of the form mould and intermediate space, and only when the product mould is filled a pressure difference is applied by providing a non-hardening slurry level above or below the wet concrete surface level in the product mould.

It is noted that when a mould is made of thin and/or light weight material, a small pressure difference is enough to position the wall against a positioning frame. Furthermore, the pressure difference caused by a level difference of one or two centimeters is generally low enough to not damage moulds made of for example vacuum moulded plastic sheet material. However, when thin, for example foil like materials, are used to form the product cavity or parts thereof, a smaller level difference may be sufficient to position the mould against a positioning frame.

In a method according to the invention, the concrete is removed from the product mould after removing the concrete product from the slurry basin. Thus, the slurry basin can be used with another product mould while the previously made product still has to be removed from its product mould. It may thus also be possible to allow the final stages of the hardening of the concrete product to take place outside the slurry basin.

In a method according to the invention, the slurry is removed from the intermediate space, preferably prior to removing the concrete product from the slurry basin, and the slurry removed from the intermediate space is stored in a slurry reservoir such that it can be reused when providing a subsequent concrete product.

Removing the non-hardening slurry prior to removing the product from the slurry basin facilitates removing the product from the basin. Reusing the slurry allows for an efficient production process. In another method new slurry is provided with the production of each product.

The invention furthermore provides a slurry basin for use in a device and/or a method according to the invention. It is noted that a slurry basin according to the invention is able to receive the product mould such that when the product mould is filled with wet concrete, the slurry basin, more in particular the intermediate space between the product mould and the slurry basin, can be filled with non-hardening slurry such that the non-hardening slurry surface level is substantially level with the wet concrete surface level. Thus, the product mould, more in particular the pressure of the wet concrete on the product mould, is fully supported, ore in particular: is balanced, by the non-hardening slurry in the slurry basin.

In a further embodiment, inserts, such as Styrofoam body elements, can be inserted in the slurry basin to reduce its volume when using it in combination with a small product mould. In another embodiment, the slurry basin is provided with moveable wall segments to adjust the volume of the slurry basin such that it better fits a particular product mould positioned in the slurry basin, thus keeping the volume of the intermediate space limited. This is advantageous, because when the volume of the intermediate space is substantially larger than the volume of the product cavity, it may be more difficult to fill both at the same rate and keep the surfaces levels substantially level with each other.

In an embodiment according to the invention, the slurry basin and the product mould are dimensioned such that the intermediate space runs around the entire product mould. In another embodiment, the product mould is positioned against one or more walls of the slurry basin such that, during the filling of the mould and the intermediate space, the product mould is partially supported by the wall of the slurry basin and partially by the non-hardening slurry in the slurry basin.

A device and a method according to the invention allow for a product mould that does not need to be able to support the weight of the wet concrete, and does not need an internal or external support frame to enable the product mould to support the weight of the wet concrete.

Advantageous embodiments of the device according to the invention and the method according to the invention are disclosed in the sub claims and in the description, in which the invention is further illustrated and elucidated on the basis of a number of exemplary embodiments, of which some are shown in the schematic drawing.

DETAILED DESCRIPTION OF THE INVENTION

Figure 1:
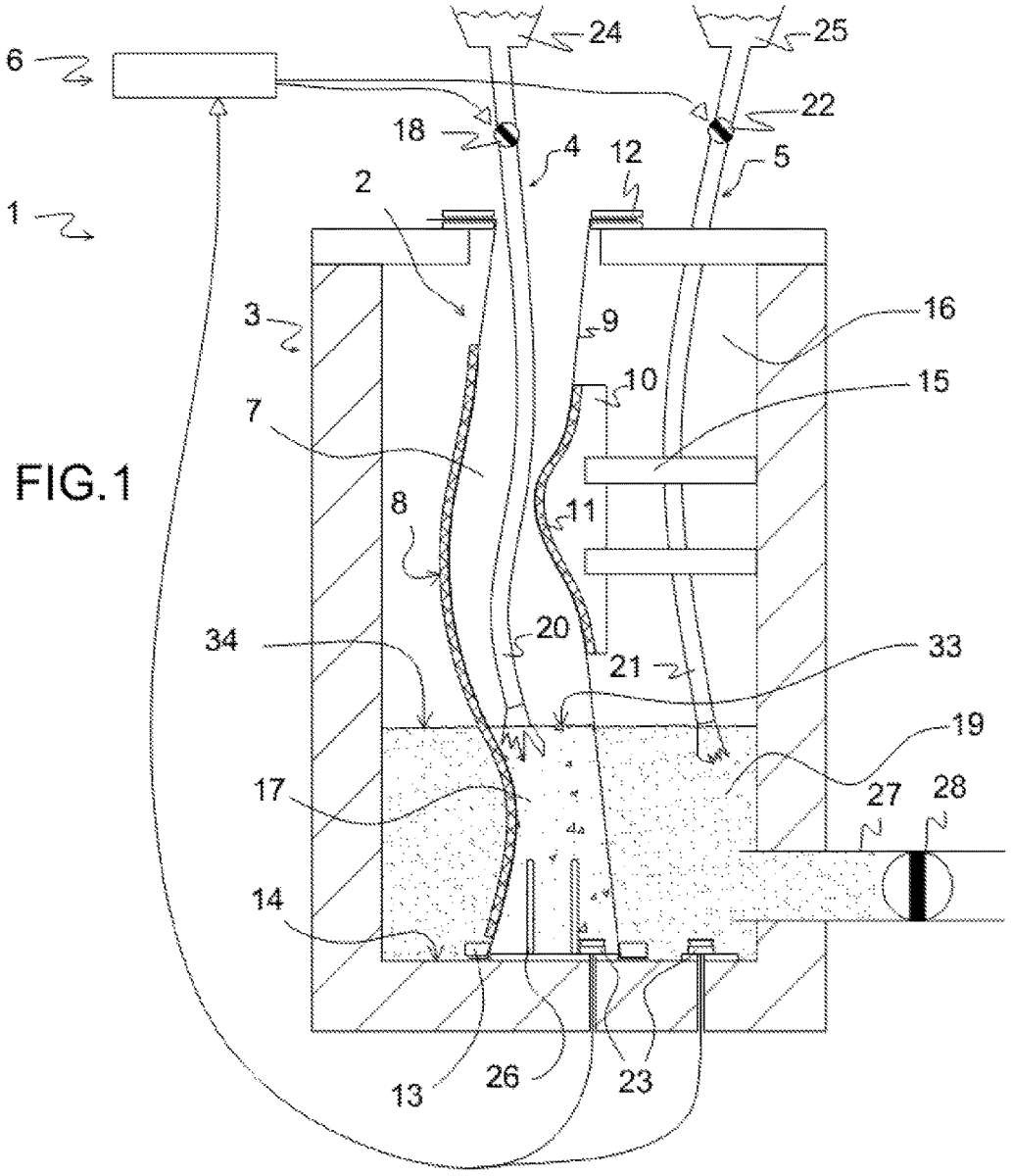
FIG. 1 shows a schematic side view in cross section of a first embodiment of a device according to the invention.

FIG. 1 shows a schematic side view in cross section of a first exemplary embodiment of a device 1 for casting a concrete product according to the invention. The device 1 comprises a product mould 2, a slurry basin 3, a wet concrete supply device 4, a non-hardening slurry supply device 5 and a control system 6. The product mould 2 is partially filled with wet concrete 17, providing a wet concrete surface level 33, and the slurry basin 3 is partially filled with a non-hardening slurry 19, providing a non-hardening slurry surface level 34.

The product mould 2 defines a product shape defining cavity 7, the cavity being delimited by an outer wall 8 of the mould. In the particular embodiment shown, the product mould 1 is substantially cylinder shaped a placed centrally in the cylinder shaped slurry basin 3.

The product mould 2 is formed using a tube of flexible, sheet like fabric material 9. The sheet like material is suitable for contact with wet concrete, and provided with a coating to facilitate removing the sheet like material from a concrete product formed in the mould. The sheet like material 9 is fastened at its top end to a ring 12 secured on top of the basin 3, and at its bottom end to a second ring 13 lying on a bottom surface 14 of the slurry basin 3. The product mould is thus supported by the top of the slurry basin to prevent the product mould, more in particular the flexible sheet like material 9, from collapsing.

It is noted that the product mould 2 has an open bottom, such that the bottom of the product cavity 7 is defined by the bottom of the slurry basin 3.

It is noted that, when the bottom of the product cavity is defined by the bottom of the slurry basin, a sheet, foil, coating, etc. can be applied to the bottom surface of the slurry basin to prevent the wet concrete from adhering to the bottom surface of the slurry basin.

In the embodiment shown, an insert 26 is provided in the product cavity. When the wet concrete has hardened in the product cavity, the insert forms part of the final concrete product. In the embodiment shown, the insert forms a foot of the final concrete product.

In the embodiment shown the slurry basin 3 is provided with a bottom wall. In an alternative embodiment, the slurry basin comprises no bottom, and is positioned on an existing support structure, for example a floor element in a building. This is for example useful when casting a concrete product in situ, for example when casting a concrete product on a bracket that is partially received in an existing concrete floor element and which is to be incorporated in the final concrete product to be casted using the device according to the invention. In such an embodiment, the product mould is mounted on the floor element such that the bracket extends into the product cavity. The slurry basin can subsequently be raised around the product mould. In an embodiment, the slurry basin is provided with a flexible sheet to cover the surface of the existing support surface, e.g. a floor element, inside the intermediate space. Thus, the non-hardening slurry does not stain or otherwise influences the existing floor element. This technique can also be used for example for providing concrete support structures, for example for buildings, bridges, etc., in situ. These kinds of structures are often too large to be transported and thus are preferably made where they are to be used.

It is noted that the use of inserts when moulding concrete products is known in the art, and that many types of inserts can be used with a device according to the invention. For example, an insert can be provided near the top of the product cavity which provides the final product with hooks or brackets for mounting the product. In a further embodiment, the product cavity is provided with inserts, for example Styrofoam blocks, that constitute a hole, being for example a door or a window, in the final product. In a further embodiment according to the invention, the product cavity can be provided with spacers to position for example the outer walls of the form mould relative to each other. Such an insert is for example temporarily attached to the wall of the product mould, to a positioning frame provided in the product cavity, or to an external support structure for supporting the insert, for example supporting the insert from above the product cavity. Other known types of inserts can be used.

The product mould shown in FIG. 1 is furthermore formed using a first form element 10 and a second form element 11, both of material less flexible than sheet 9. The sheet material 9 is glued to the form elements 10, 11, such that flexible sheet material forms the surface of these form elements 10, 11. The first form element 10 is supported by the sheet like material 9, while the second form element is mounted via a bracket 15 to a wall of the basin 3. The bracket 15 and the wall of the basin thus form a positioning frame, that positions part of the support mould.

The flexible sheet 9, support rings 12, 13 and form elements 10, 11 form the product shape defining cavity 7 to be filled with wet concrete that hardens in the cavity to form the concrete product.

The slurry basin 3 in the embodiment shown is adapted to fully receive therein the product mould 2 such that an intermediate space 16 is present between a portion of the outer wall 8 formed by the sheet 9 and the first form element 10. The intermediate space 16 inbetween the non-hardening slurry basin 3, more in particular the slurry basin wall, and the product mould 2 almost covers the entire outer surface of the product mould 2, more in particular the outer surface of the outer wall 8 of the product mould 2. The part of the wall 8 of the product mould 2 formed by second form element 11 is covered by support bracket 15 of the product mould 2. The intermediate space runs along the surface of the outer wall 8 not covered by the support bracket 15.

In FIG. 1, the product cavity is in the process of being filled. The wet concrete supply device 4 is adapted to feed wet concrete 17 into the product cavity 7 of the product mould 2. In the embodiment shown, the concrete supply device comprises an inlet in the form of a tube 20 for guiding the wet concrete into the product cavity. Alternative types of conduits and channels can be used. The concrete supply tube 20 is with one end connected to a wet concrete supply reservoir 24 (schematically shown). The tube is supported with its other end located in the product cavity 7. The wet concrete supply tube is provided with a valve 18 for controlling the flow of wet concrete 17 through the tube from the wet concrete supply reservoir 24 to the product shape defining cavity 7. In the embodiment shown, the concrete supply tube is lifted from the product cavity while the cavity is filled, preferably such that the tube outlet is kept just above the wet concrete surface level during the filling process.

Lifting the inlet while filling the cavity can be achieved in many ways. For example, the tube can be provided on a reel which is turned by a motor drive to lift or lower the outlet end of the tube. In such an embodiment, the motor drive is connected to a control system monitoring at least the wet concrete surface level, or a representative thereof. Thus, the control system can keep the tube end at a constant position relative to the wet concrete surface level, for example just below or just above the wet concrete surface level, during the filling process.

In an alternative embodiment, the concrete supply tube is kept stationary during the filling process and is only removed from the product shape defining cavity after the product cavity has been filled with wet concrete.

The non-hardening slurry supply device 5 is adapted to feed a non-hardening slurry 19 into the intermediate space 16 between the outer wall 8 of the product mould 2 and the slurry basin 3, more in particular the inside surface of the slurry basin 3. In FIG. 1, the intermediate space is in the process of being filled.

In the embodiment shown, the non-hardening supply device comprises an inlet in the form of a tube 21 for guiding the none-hardening slurry into the intermediate space. The tube is with one end connected to the non-hardening slurry reservoir 25 (schematically shown). The slurry supply tube 21 is supported with its other end located in the intermediate space 16. The slurry supply tube 21 is provided with a valve 22 for controlling the flow of non-hardening slurry 19 through the tube from the slurry reservoir to the intermediate space 16. The supply tube can remain in the intermediate space after it has been filled with non-hardening slurry since the slurry does not harden. However, similar to the tube for filling the product mould with wet concrete, the tube for providing the non-hardening slurry preferably is removed while the intermediate space is being filled.

In the embodiment shown, the slurry basin 3 is provided with a slurry outlet in the form of a channel 27 and with a slurry outlet channel valve 28. In the Fig. the slurry basin and the mould cavity are being filled. The slurry outlet valve blocks the slurry outlet channel to allow for filing the intermediate space. After the product mould has been filled with wet concrete, and after the concrete has hardened, the slurry can be removed from the intermediate space via the outlet channel 27. Subsequently the product mould and the concrete product can be removed from the slurry basin, for example by opening the slurry basin or by lifting the product and product mould from the slurry basin.

The control system 6 is schematically shown in FIG. 1. The control system can for example comprise a computer or pc. In the embodiment shown, the control system furthermore comprises control means in the form of sensors 23 provided in the bottom wall of the slurry basin, which sensors are pressure sensors. It is noted that in the embodiment shown, the product mould has an open bottom such that the bottom of the product cavity is defined by the bottom of the slurry basin. The pressure sensors in the part of the bottom of the slurry basin 3 that forms the bottom of the intermediate space 16 provide information on the pressure of the non-hardening slurry 19 in the intermediate space, and thus on the non-hardening slurry surface level 34. The pressure sensors in the part of the bottom of the slurry basin that forms the bottom of the form mould or product cavity provide information on the pressure of the wet concrete 17 in the product cavity 7 and thus on the wet concrete surface level 33.

The control system 6 furthermore controls the wet concrete supply valve 24 and the slurry supply valve 25. Thus, the control system can adjust, i.e. reduce or increase the flow of wet concrete and non-hardening slurry.

In the embodiment shown in FIG. 1, the control system is thus able to use the information provided by the pressure sensors at the bottom of the product cavity and the intermediate space to adjust the flow of the wet concrete and the flow of non-hardening slurry into the product cavity and the intermediate space respectively and to thus control the pressure below, and thus the surface levels in, the respective product cavity and intermediate space, while filling the product cavity with wet concrete and the intermediate space with non-hardening slurry.

With a device according to the invention shown in FIG. 1 a concrete product can be provided by way of a method according to the invention.

The device shown comprises a product mould 2, the product mould defining a product shape defining cavity 7 for receiving wet concrete to form the concrete product, and a non-hardening slurry basin 3, which slurry basin is adapted to receive the product mould 2.

The slurry basin 3 is a tank like structure with a removable top. The top is removed for positioning the product mould in the slurry basin, and, after casting and hardening of the concrete, for removing the product mould and concrete product from the basin. The product mould is provided inside the tank such that an intermediate space between the slurry basin and at least part of the product mould is created. In the particular embodiment shown, the product mould and parts thereof are partially supported by the slurry basin. Thus, the outside wall of the product mould is almost over its entire surface in contact with the intermediate space.

In the situation shown in FIG. 1 the product mould 2 has been positioned in the slurry basin 3. A non hardening slurry inlet tube 21 has been positioned in the intermediate space 16, and a wet concrete supply tube 20 has been positioned in the product cavity 7.

Furthermore, the product cavity 7 is being filled with wet concrete 17 and the intermediate space 16 is being filled with non-hardening slurry 19 having a density substantially similar to the density of the wet concrete.

While filling the product cavity 7 with wet concrete 17 and the intermediate space 16 with non-hardening slurry 19, the level difference between the wet concrete surface level 33 and the non-hardening slurry surface level 34 is controlled by a control system 6. The level difference between the non-hardening slurry surface level 34 and the wet concrete surface level 33 in the situation shown is substantially zero. Thus, the pressure of the wet concrete upon the inside of the outer wall 8 is balanced by the pressure of the non-hardening slurry on the outside of the outer wall 8. Thus, the flexible sheet like material of the product mould is not pressed outward or inward, and the final product will have a shape conform the product mould prior to filling it with wet concrete.

During the filling of the product cavity and the intermediate space, the pressure in the wet concrete and the non-hardening slurry is measured near the bottom of the basin, and the flow of concrete and slurry into the respective product cavity and intermediate space is adjusted if necessary to keep the non-hardening slurry surface level and the wet concrete surface level substantially level. Alternatively or in addition, during the filling of the product cavity and the intermediate space, the wet concrete surface level and/or the slurry surface level in the respective product cavity and the intermediate space are directly measured while filling the product cavity and the intermediate space, for example using optical sensors or a floater type device.

It is noted that as an alternative, the filling process can be executed and/or controlled by hand, for example by manually operating the inlet valves.

When the filling of the product mould 2, and thus the filling of the intermediate space 16, have been completed, the supply tubes 20, 21 are removed from the product cavity and the intermediate space, and the wet concrete is left to harden. In the embodiment shown, the supply tubes are lifted during the filling process in pace with the rising surface levels, such that they are removed from the respective spaces when these are filled. After the filling process has been completed, the non-hardening slurry is left in the intermediate space until the concrete has sufficiently hardened. Subsequently the slurry is removed from the intermediate space via the slurry outlet channel 27 and the concrete product and the product mould are removed from the slurry basin.

It is noted that in the embodiment shown, the product is removed via the top of the slurry basin. In an alternative embodiment for example the slurry basin comprises two parts which are secured, for example hingeably connected, to each other to form the basin. The parts can thus be separated from each other to open the basin and allow easy access to the slurry basin and to facilitate positioning a product mould inside the basin and removing a product mould and or product from the basin. Alternative embodiments are also possible.

When the concrete product has been removed from the product mould, the concrete product is ready. However, it is possible that the concrete needs to harden further and/or further processing, for example treatment of the outer surface of the product, is required.

It is noted that in an embodiment according to the invention, the product mould, or part thereof, remains part of the finished concrete product.

Figure 2:
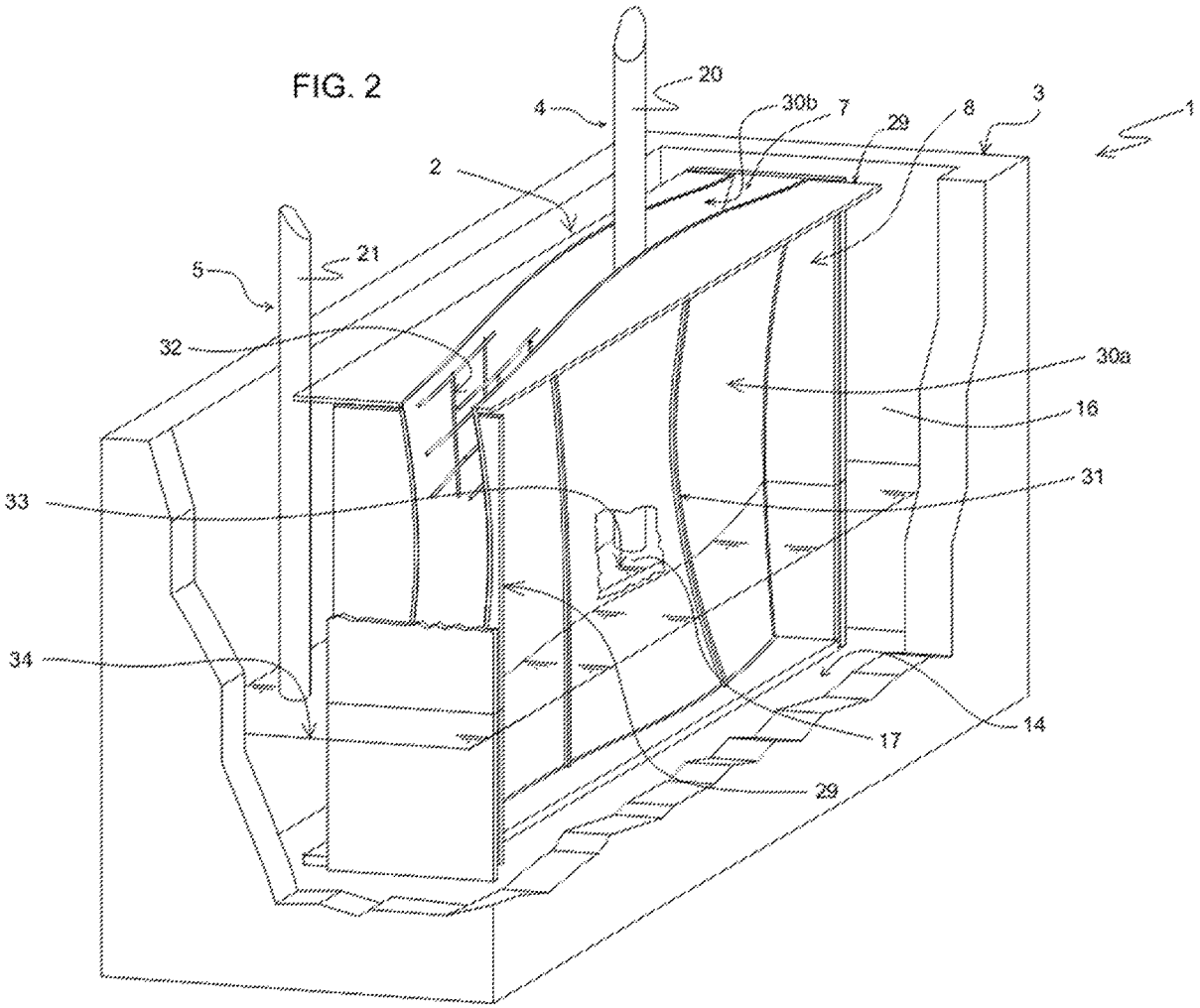
FIG. 2 shows a schematic perspective view in cross section of a second embodiment of a device according to the invention.

FIG. 2 shows an alternative device according to the invention in perspective view, partially in cross section. In FIG. 2 those features which are similar to the ones of the device shown in FIG. 1 are provided with identical reference signs. The features are not again explained. In the embodiment shown in FIG. 2 pressure sensors are provided at the bottom surface of the product cavity and, at the same height, in the intermediate space. The pressure sensors and the control system are not shown in FIG. 2 but are similar to the ones shown in FIG. 1.

The device shown in FIG. 2 differs from the one shown in FIG. 1 mainly in the construction of the product mould. In the embodiment shown in FIG. 2, the product mould comprises a frame 29, comprising a bottom, side walls and a top. The frame is self-supporting, made from flat wooden or metal plates, and simple in form. Within the frame, on opposite sides of the product cavity, two flexible sheets 30*a* 30*b* are mounted. The sheets are made of a plastic material having a thickness of about 0.2 mm. The sheets 30 are along their edges connected to the frame 29, for example using staples, tape and/or glue, such that the sheets form a curved surface. Furthermore, a positioning frame, in the form of ribs 31, is provided. The ribs are with their ends secured to the frame and extend along the outer surface of the sheets to correctly position them and further shape the mould. The function of these positioning ribs is similar to the function of the second form element 11 in FIG. 1, however, the sheets 30 are not fixed to the ribs but loosely lie against it.

The product cavity shown in FIG. 2 is thus defined by the frame 29 and the sheets 30 supported by that frame and the support ribs 31. The product cavity is open along the top to allow filling of the cavity. Furthermore, the open top provides an air drain that prevents enclosed air to get trapped in the cavity during the filling process. It is noted that the intermediate space is also provided with such an air drain.

In contrast with the product mould shown in FIG. 1, the product mould show in FIG. 2 is not supported by parts of the slurry basin. The product mould in FIG. 2 can thus be moved in and out of the slurry basin without demolishing it.

Figure 4:
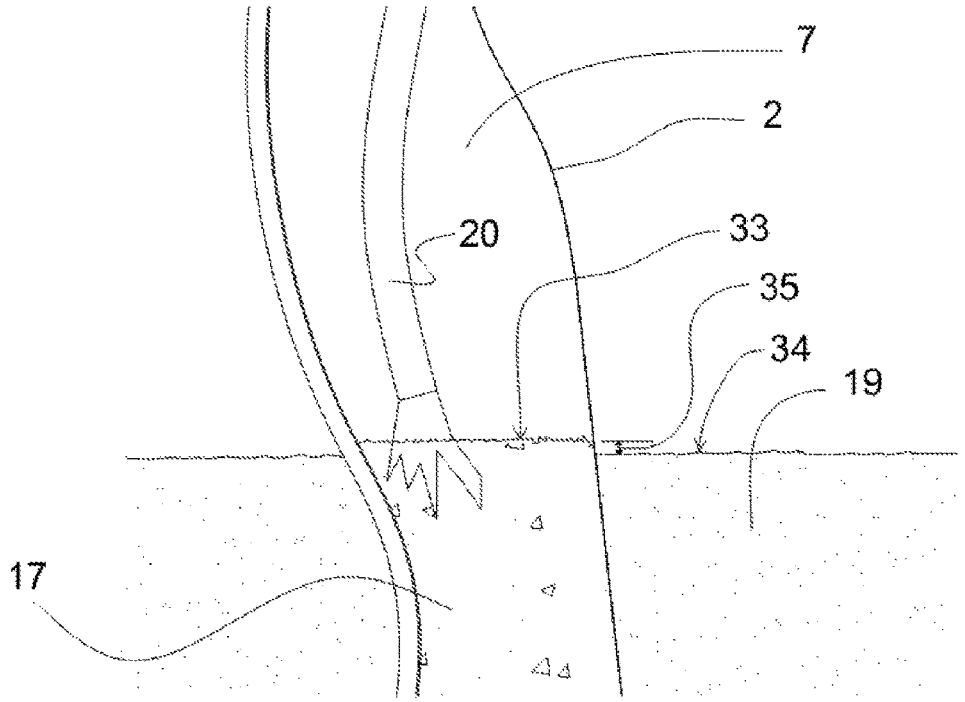
FIG. 4 shows a detail in cross section of the embodiment of FIG. 2.

FIG. 4 shows a detail in cross section of the embodiment of FIG. 2. Depicted are part of the intermediate space 16 and the non-hardening slurry 19 provided therein, part of the product cavity 7 of the product mould 2 and the wet concrete 17 provided therein, and the concrete supply tube 20. FIG.

4 furthermore depicts the wet concrete surface level 33 and the non-hardening slurry surface 34. It is noted that in the particular embodiment shown, the wet concrete surface level 33 is located slightly above the non-hardening slurry surface level 34. This creates a level difference 35, i.e. a vertical distance between the wet concrete surface level and the non-hardening slurry surface level.

According to the invention this level difference is controlled during the filling of the product mould and the slurry basin, more in particular during the filling of the form cavity and the intermediate space. The level difference is controlled by controlling the wet concrete surface level and/or the non-hardening slurry surface level. By controlling the wet concrete surface level and the non-hardening slurry surface level the pressure in the wet concrete inside the mould and the pressure in the non-hardening slurry outside the mould are controlled. Thus, by controlling the level difference between the wet concrete surface level on one side of the wall of the mould and the non-hardening surface level on the opposite side of the wall, the pressure to which the wall of the mould is exposed to is also controlled. When the wet concrete surface level and the non-hardening surface level are level with each other, the level difference, i.e. the vertical distance between the two surface levels, is substantially zero and the pressure difference between the inside and the outside of the wall of the mould is also substantially zero. When the level difference is increased, the pressure difference between the inside and the outside of the wall of the mould is also increased. Due to this pressure difference the wall of the mould is displaced and/or exposed to stresses.

According to the invention, the level difference is controlled such that pressure differences which may damage the mould are avoided. This can be done by keeping the level difference to a minimum, preferably substantially zero. It is noted that small pressure differences may be useful in correctly stretching the mould or positioning the wall of the mould during the filling process. Thus, small pressure differences may be provided during parts of the filling process, or be maintained throughout the filling process, to help the mould to keep its correct shape or to attain its correct shape.

In the situation shown in FIG. 2 the product cavity 7 and the intermediate space 16 are both partially filled. It is noted that by providing a wet concrete surface level 33 slightly above the non-hardening slurry surface level 34, a slight over pressure is created inside the mould 8, more in particular inside the product cavity, and the sheets 30*a*, 30*b* are pressed outward and thus positioned and/or secured in their position against the positioning ribs 31 provided along the outside surface of the product mould.

It is noted that the device in FIG. 2 is partially shown in cross section. Part of the slurry basin 3 has been removed to show the product mould 2 in the slurry basin and the non-hardening slurry in the intermediate space 16, and part of the foremost sheet 30*a* has been removed to show the wet concrete surface level inside the product cavity 7. In the product cavity an insert in the form of a framework 32 is provided to provide the final concrete product with additional structural strength. In a further embodiment according to the invention, the framework can also function as a positioning frame for positioning the walls of the product mould during the filling process.

Figure 3:
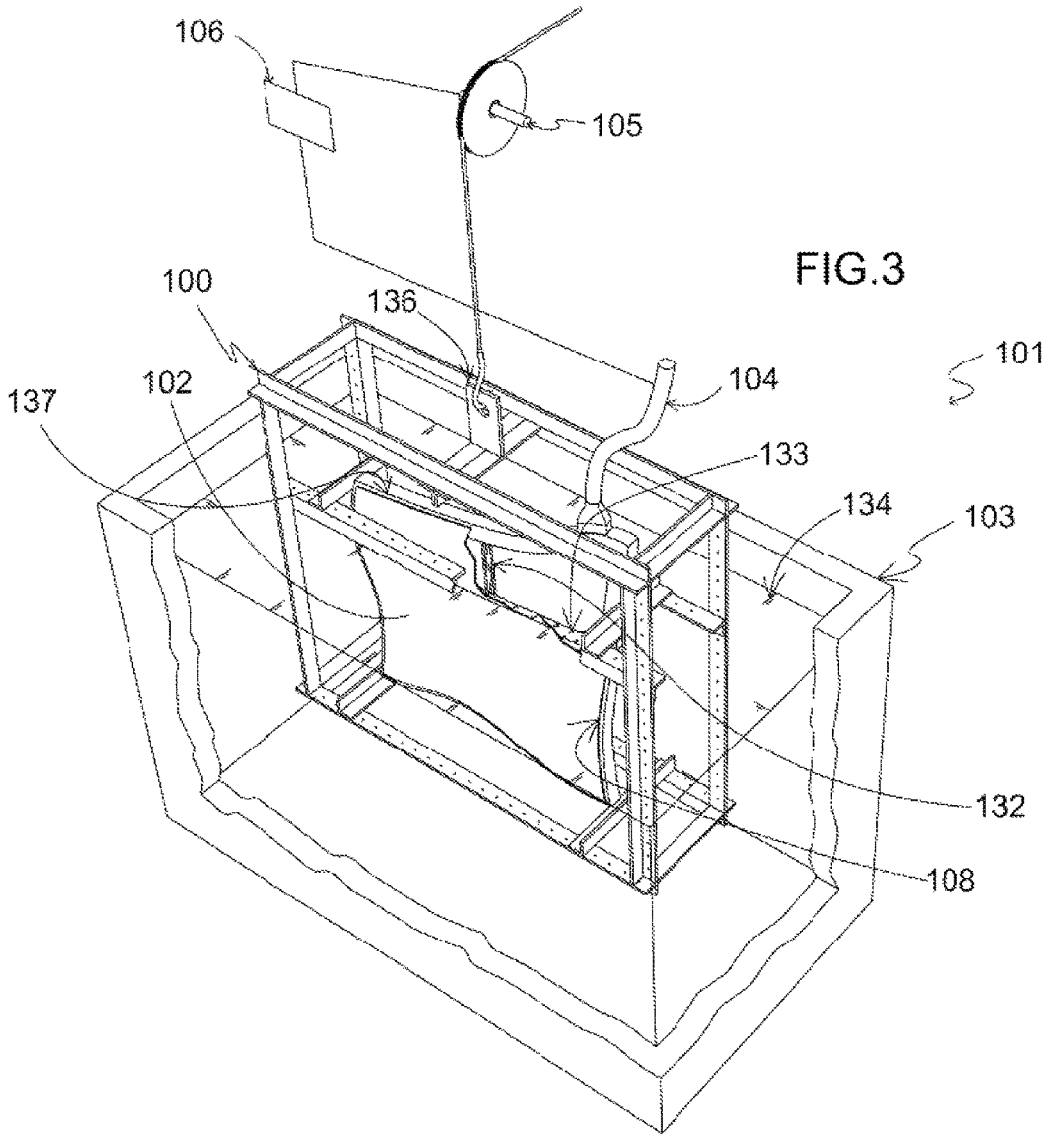
FIG. 3 shows a perspective view of a third embodiment of a device according to the invention, in which the slurry basin is partially shown in cross section.

FIG. 3 shows a perspective view of a third embodiment of a device according to the invention. FIG. 3 shows a device 101 according to the invention, comprising a product mould 102, a slurry basin 103, a wet concrete supply device 104, a lowering device 105, a control system 106, and a slurry basin 103, partially shown in cross section.

The product mould 102 comprises a round going form defining frame 137 and two outer wall sections 108. The frame 137 supports the outer wall sections 108 on opposite sides thereof. An inlet is provided at the top of the frame 137, which inlet is coupled to the wet concrete supply device 104. Inside the product mould 102 a product mould positioning frame 132 is provided to further position the outer wall sections 108.

For example, the round going frame can be 3D printed and the wall sections can be a plastic sheet material. Alternatively, the entire mould can be 3D printed.

The product mould 102 is provided in a product mould transport frame 100. In the particular embodiment shown the product mould transport frame 100 is a steel frame. Alternatively, the product mould transport frame can be made off for example wooden beams, plastic profiles, etc. The product mould transport frame 100 is configured to enable moving the product mould 102 and also functions as a product mould support for positioning parts of the product mould 102, more in particular for positioning the form defining frame 137 of the product mould 102.

The product mould transport frame 100 and the product mould 102 are partially shown in cross section, such that the product mould positioning frame 132 and the wet concrete surface level 133 inside the mould are visible.

In contrast with the embodiments shown in FIGS. 1 and 2, in the embodiment shown in FIG. 3 the product mould 102 is lowered into the non hardening slurry basin during the filling of the product mould with wet concrete. Therefore the product mould is provided in the product mould transport frame 100. The product mould transport frame, and thus the product mould, is supported by a crane like lowering device 105. The product mould transport frame furthermore supports the wet concrete supply means 104, which are configured for providing a flow of wet concrete into the product cavity of the product mould.

In the particular embodiment shown, the product mould is closed along its top side. Providing the mould with an at least partially closed top end allows for casting products having a curved top surface. Furthermore, when the product mould is fully closed along its top end it can be fully submerged into the slurry. Thus, when the product mould is fully filled with wet concrete, the non-hardening slurry surface level 134 can be raised above the top of the product mould 102.

In the embodiment shown, the control system 106 is linked to the lowering device 105 and the wet concrete supply device 104. The control device is furthermore provided with sensors (not shown in the Fig.) located on the product mould transport frame 100 to monitor the non hardening slurry surface level 134 relative to the product mould transport frame, more in particular relative to the product mould during the lowering of the product mould into the non hardening slurry. The control system 106 can adjust the flow rate of the wet concrete and/or the speed at which the product mould 102 is lowered into the non hardening slurry to control the distance between the wet concrete surface level 133 inside the product mould and the non hardening slurry surface level 134 in the slurry basin 103, for example keep them substantially level or at a constant level difference of 2 cm, during the filling process. Preferably, the control system is provided with control means for monitoring the wet concrete surface level, and the rising thereof, inside the product mould during the filling and lowering into the slurry of said mould.

It is noted that it is also possible to add slurry to or remove slurry from the non hardening slurry basin while the product mould is lowered into the slurry.

For example, in an alternative embodiment, the non hardening slurry basin is provided with slurry removal means, for example a pump or an overflow, to keep the non hardening slurry surface level at a constant level. Such a slurry basin is filled with non hardening slurry up to a level sufficient for submerging the product mould in the non hardening slurry. When the product mould is lowered into this slurry basin, while being filled with wet concrete, the non hardening slurry replaced by the product mould and wet concrete is removed from the slurry basin, keeping the non hardening slurry surface level in the slurry basin at a constant level. Thus, in such an embodiment, the non hardening slurry surface level is known and does not need to be monitored by the control system. Thus the control system only needs to actively control the lowering of the product mould into the non hardening slurry and or the flow of concrete into the product mould, to keep the wet concrete surface level at a correct position relative to the non hardening slurry surface level, for example level with the non hardening slurry surface level.

The particular product mould transport frame shown in FIG. 3 is of a cage like configuration, enclosing the product mould. Alternatively, the transport frame can only partially enclose the product mould.

On top the product mould transport frame 100 shown in FIG. 3 is provided with connecting means 136 for cooperating with the crane type lifting device 105. In the particular embodiment shown the product mould transport frame is provided with a ring type fastening device to be engaged by a hook of the lifting device, to enable lifting and lowering the product mould transport frame into and out of the non hardening slurry basin using the lifting means.

In another embodiment, the product mould is configured such that it can be directly supported by lowering device, and the product mould transport frame is absent. In another alternative embodiment, the product mould is supported on a foot plate, which is provided with fastening means for coupling with a lowering device.

Preferably, the product mould is provided with a product mould transport frame to facilitate moving the product mould. When providing the product mould with a product mould transport frame, the product mould can be comparatively delicate and of a complicated design, while the product mould transport frame is comparatively firm, for example be made from wood ore steel profiles, and of a simple design. The product mould transport frame is for example provided with coupling means for cooperating with a lowering and/or a lifting device for lowering and/or lifting the product mould transport frame, and thus the product mould, into and/or out of the non hardening slurry basin.

The non-hardening slurry preferably closely matches the concrete in all aspects but the hardening. Like wet concrete, the slurry comprises a coarse aggregate, sand and water. The non-hardening slurry preferably has a density substantially similar to the density of concrete. In an embodiment the non-hardening slurry matches the mass and the viscosity of the wet concrete. In an embodiment, the non-hardening slurry also matches the thixotropic properties of the wet concrete. In an embodiment, the non-hardening slurry comprises a mixture of natural gravel, sand, betonite, barium sulfate and water, for example, for one cubic meter of slurry, 865 kg natural gravel, 860 kg sand, 25 kg bentonite, 175 kg barium sulfate, and 235 liters water. Bentonite is added for mirroring the characteristics of cement in the wet concrete, in particular to copy the thixotropic characteristics of the wet concrete. For fine tuning the specific mass of the non-hardening slurry, a high density material like barium sulfate is added.

In an alternative embodiment, one cubic meter of non-hardening slurry comprises a mixture 27 kg bentonite, 1500 kg barium sulfate, 630 liters water and no gravel or sand. Such a mixture is in particular suitable for use with a device according to the invention in which the product mould is lowered into the slurry during the filling of the product mould with wet concrete.

Other configurations of the slurry are also possible.

It is noted that non-hardening slurries that match the properties of wet concrete are known in the art. It is believed that the common general knowledge of the skilled person and the information provide in this text provide the skilled person with sufficient information to enable the skilled person to provide a non-hardening slurry that sufficiently matches the properties of wet concrete to be used to cast a product.

In an embodiment, the wet concrete is self-compacting, and the slurry matches the properties of the self-compacting wet concrete. The self-compacting concrete needs no additional supply of compacting energy, such as mechanical stifling of the wet concrete. Thus, the risk that a disturbance in the hydrostatic pressure, caused by the applied compacting energy, would lead to a deformation of the outer wall of the product mould, and thus to a deformation of the final product, is reduced.

A device and method according to the invention can be used to manufacture concrete products of different size and shape, for example concrete objects which are round, circular, square, rectangular or are any other well-defined linear or symmetrical shape, such as walls, floor slabs, pillars, tiles and a few other constructional elements. The invention allows for a simplified construction of the formworks or product mould. The device and method according to the invention are therefore especially beneficial when manufacturing concrete product with a non-flat surface, for example a curved or wave like surface.

In an embodiment, the device according to the invention is provided with a product mould that is shaped to mould a concrete product that constitutes a beam or beamlike structure, having a rectangular, square, circle, ellipse, or polygon cross-section. In another embodiment, the mould is shaped for providing a concrete object having an irregular cross section.

It is furthermore observed that since the hydrostatic pressure exerted by the wet concrete and the non-hardening slurry on opposite sides of the outer wall of the product mould is substantially similar, the risk of leakage and the wet concrete flowing from the mould is substantially eliminated. Also for this reason, the construction of the mould is less critical.

It is noted that with a device according to the invention, the slurry basin has to be able to support the volume of wet concrete and non-hardening slurry. The basin is thus comparatively heavy build compared to the product mould which is subjected to minimal pressures only. The slurry basin however can be of a simple design, for example box or cylinder shaped, and can be used with multiple form moulds. The form moulds can be of a complicated design. However, since the product mould does not need to support substantial pressures, it can be made of simple, light weight, and flexible materials. The product mould is thus easy to assemble. The combination of a slurry basin with a form mould according to the invention thus provides a fast and low cost way to manufacture curved concrete products, in particular concrete products of different shapes.

It is noted that for providing support to the product mould, the non-hardening slurry surface level in the slurry basin is relevant. The slurry basin can thus in principle be provided in any kind of size and shape suitable for holding one, or more, product moulds. In a preferred embodiment, the basin has a rectangular lay out with a flat bottom floor. Preferably, the basin is dimensioned such that, when a product mould is placed in the basin, the volume of the intermediate space is substantially similar or smaller than the volume of the mould cavity.

In an embodiment, the slurry basin has a rectangular lay out with a width of about 1 m, for example 0.8 m, a length of over 5 m, for example 8 m and a depth of over 3 m, for example 3.6 m. Other dimensions and/or ratios are possible. For example, the basin can be provided with a rectangular floor surface.

In an embodiment, the slurry basin is built up out of standard modular panels as are commonly used in falsework for wall type constructions. In this embodiment these panels constitute a barrier for the slurry.

The product mould can be provided in different kind of shapes, as long as the height of the product to be made is not larger than the depth of the basin. The form mould is preferably placed on the bottom floor of the slurry basin. However, it is also possible to for example hang the product mould in the basin from an overhead crane, or support the product mould in the basin with a support structure.

In an embodiment, the product mould has a curved surface and an overall width of less than 1 m, for example 0.2 m, and an overall height of more than 3 m, for example 3.6 m. Other dimensions and/or ratios are possible.

In an embodiment, metal sheets with a thickness of 2.0 mm are used to form a product mould for a typical one story high building element. By supporting the metal sheet walls of the product mould with the non-hardening slurry according to the invention, additional supports in the form of for example elaborate scaffolding or traditional formworks can be avoided.

It is noted that a slurry basin of a device according to the invention can be used with moulds of different shapes and sizes, as long as they fit in the basin. When the form mould is substantially smaller than the basin, inserts, for example Styrofoam or wooden blocks, can be placed in the basin to reduce the volume thereof. Thus the difference between the volume of the basin and the volume of the product cavity is limited. This facilitates filling both at a substantial similar speed. Furthermore, the over-all volume of non-hardening slurry needed for filling the basin is reduced.

It is noted that according to the invention filling the intermediate space in pace with the filling of the product cavity provides a counter pressure build up on the outside of the outer wall of the product mould that matches the pressure build up on the inside of the outer wall of the product mould. Such a pressure build up is not possible when the intermediate space is filled prior to or after filling the product mould with wet concrete, and/or when the intermediate space is filled with a fluid such as a gas or a slurry that not substantially matches the properties of the wet concrete, such as water.

In an embodiment according to the invention, the non-hardening slurry or the wet concrete is provided at a predetermined volume per minute, and respectively the flow of the wet concrete or the non-hardening slurry is controlled, and if needed adapted, to control the level difference between the respective surface levels.

Furthermore, the product mould of a device according to the invention only defines the shape of the product to be made, and does not need to support the weight of the wet concrete in the product cavity. Therefore the mould design can be kept simple.

Also, because the product mould according to the invention does not need to support the weight of the wet concrete, changes to the shape of the mould do not require a redesign of the overall product mould to prevent collapse when filled with wet concrete. A device according to the invention thus enables the use of moulds of which the form cavity can be changed without much effort and thus enables the production of a great variety of products in less time and/or against lower costs when compared to known formworks.

In this text the terms "form mould" and "product mould" are considered interchangeable because they relate to the same feature of the invention, i.e. the mould that shapes the final product.

The invention claimed is:

1. A device for casting a concrete product, the device comprising:

a product mould, the product mould defining a product shape defining cavity, said cavity being delimited by an outer wall of the mould and being adapted to be filled with wet concrete that hardens in the cavity to form the concrete product, a slurry basin, which slurry basin is adapted to receive therein at least partially the product mould such that an intermediate space is present between at least a portion of the outer wall of the product mould and the slurry basin, a wet concrete supply device, which wet concrete supply device is adapted to provide a flow of wet concrete into the product cavity of the product mould to fill the product cavity with wet concrete, a non-hardening slurry supply device, which non-hardening slurry supply device comprises a slurry storage for storing a non-hardening slurry having a density substantially similar to the density of concrete, and which non-hardening slurry supply device is adapted to provide a flow of the non-hardening slurry into the intermediate space present between at least a portion of the outer wall of the product mould and the slurry basin, to fill the intermediate space with non-hardening slurry, and a control system, the control system comprising a control device adapted to control filling of the product cavity and/or filling of the slurry basin such that, while filling the product cavity with wet concrete and the intermediate space with non-hardening slurry, the level difference between the wet concrete surface level inside the product mould and the slurry surface level in the intermediate space of the slurry basin can be controlled.

2. A device for casting a concrete product, the device comprising:

a product mould, the product mould defining a product shape defining cavity, said cavity being delimited by an outer wall of the mould and being adapted to be filled with wet concrete that hardens in the cavity to form the concrete product, a slurry basin, which slurry basin is adapted to receive therein at least partially the product mould such that an intermediate space is present between at least a portion of the outer wall of the product mould and the slurry basin, a lowering device configured for, when the slurry basin is at least partially filled with slurry, lowering the product mould into the slurry basin, more in particular for lowering the product mould into non hardening slurry held by the slurry basin, such that an intermediate space filled with non hardening slurry is present between at least a portion of the outer wall of the product mould and the slurry basin, a wet concrete supply device, which wet concrete supply device is adapted to provide a flow of wet concrete into the product cavity of the product mould to fill the product cavity with wet concrete, which wet concrete supply device is adapted to provide the flow of wet concrete into the product cavity of the product mould while the product mould is lowered into the slurry held in the slurry basin, and a control system, wherein the control system comprises a control device adapted to control the lowering device and/or the wet concrete supply device, and is adapted to control the lowering of the product mould and/or the supply of the wet concrete such that, while the product cavity is being filled with wet concrete, the level difference between the wet concrete surface level inside the product mould and the slurry surface level in the intermediate space of the slurry basin can be controlled.

3. The device according to claim 2, wherein the device further comprises a non-hardening slurry supply device, which non-hardening slurry supply device comprises a slurry storage for storing a non-hardening slurry having a density substantially similar to the density of concrete, and which non-hardening slurry supply device is adapted to provide a flow of the non-hardening slurry into the slurry basin, into the intermediate space present between at least a portion of the outer wall of the product mould and the slurry basin while the product mould is lowered into the basin, to fill the intermediate space with non-hardening slurry.

4. The device according to claim 2, wherein the control system is adapted to maintain the wet concrete surface level substantially level with the non-hardening slurry surface level during the filling of the product cavity with wet concrete and the intermediate space with non-hardening slurry, such that the pressure of the wet concrete against an inside of the outer wall of the form mould is substantially the same as the pressure of the non-hardening slurry against an outside of the outer wall of the form mould.

5. The device according to claim 2, wherein the control device is adapted to control the flow rate of a flow of wet concrete into the product cavity and/or to control the flow rate of a flow of non-hardening slurry into the intermediate space.

6. The device according to claim 2, wherein the device comprises a product mould transport frame, which product mould transport frame supports the product mould, wherein the slurry basin is configured for receiving the product mould transport frame supporting the product mould, and which product mould transport frame is adapted for cooperating with the lowering device, such that the product mould can be lowered into slurry held in the slurry basin by lowering the product mould transport frame into the slurry basin using the lowering device.

7. The device according to claim 1, wherein the control system is adapted to maintain the wet concrete surface level substantially level with the non-hardening slurry surface level during the filling of the product cavity with wet concrete and the intermediate space with non-hardening slurry, such that the pressure of the wet concrete against an inside of the outer wall of the form mould is substantially the same as the pressure of the non-hardening slurry against an outside of the outer wall of the form mould.

8. The device according to claim 1, wherein the control device is adapted to control the flow rate of a flow of wet concrete into the product cavity and/or to control the flow rate of a flow of non-hardening slurry into the intermediate space.

9. The device according to claim 1, wherein the device comprises a product mould transport frame, which product mould transport frame supports the product mould, wherein the slurry basin is configured for receiving the product mould transport frame supporting the product mould, and which product mould transport frame is adapted for cooperating with a lowering device, such that the product mould can be lowered into slurry held in the slurry basin by lowering the product mould transport frame into the slurry basin using the lowering device.

* * * * *